US005998917A

United States Patent [19]

Lee

[11] Patent Number: 5,998,917

[45] Date of Patent: Dec. 7, 1999

[54] FLAT PICTURE TUBE

[75] Inventor: Keum Sik Lee, Seoul, Rep. of Korea

[73] Assignee: Youare Electronics, Co., Seoul, Rep. of Korea

[21] Appl. No.: 09/080,255

[22] Filed: May 18, 1998

Related U.S. Application Data

[63] Continuation of application No. 08/428,646, Apr. 25, 1995, Pat. No. 5,804,916.

[30] Foreign Application Priority Data

Apr. 28, 1994 [KR] Rep. of Korea ..... 94/9163

[51] Int. Cl.[6] ..... H01J 29/70

[52] U.S. Cl. ..... 313/422; 313/495; 313/496; 313/306; 313/370

[58] Field of Search ..... 313/422, 495, 313/496, 497, 306, 308, 370, 463, 473; 345/74, 75

[56] References Cited

U.S. PATENT DOCUMENTS

| | | | |
|---|---|---|---|
| 3,673,572 | 6/1972 | Silva et al. | 313/463 |
| 3,936,697 | 2/1976 | Scott | 313/495 |
| 4,218,636 | 8/1980 | Miyazawa | 313/497 |
| 4,633,134 | 12/1986 | Kishino et al. | 313/497 |
| 4,694,225 | 9/1987 | Tomii et al | 313/422 |
| 4,733,139 | 3/1988 | Morimoto | 313/422 |
| 4,794,306 | 12/1988 | Tischer et al. | 315/169.3 |
| 4,881,017 | 11/1989 | Tsvrvoka | 313/495 |
| 5,189,335 | 2/1993 | Sekihara et al. | 313/422 |
| 5,191,259 | 3/1993 | Hauashi et al. | 313/422 |
| 5,453,659 | 9/1995 | Wallace et al. | 313/497 |
| 5,534,749 | 7/1996 | Ohoshi et al. | 313/497 |
| 5,604,394 | 2/1997 | Saito et al. | 313/422 |

*Primary Examiner*—Vip Patel
*Attorney, Agent, or Firm*—Smith, Gambrell & Russell, LLP

[57] ABSTRACT

A flat picture tube including a glass vessel which is internally evacuated, a heater installed inside the glass vessel for emitting heat electrons, a plurality of anodes extended in one direction and disposed at a constant interval on one inner plane of the glass vessel for absorbing the heat electrons, a plurality of fluorescent units disposed on the plurality of anodes in a matrix shape for radiating depending on heat electrons absorbed to the anodes, and a plurality of control grids extended perpendicularly to the anode extended direction and disposed in a constant interval for controlling the absorption of the heat electrons toward the anodes operates in a matrix digital method and does not necessitate an electron gun nor deflection yokes, thereby reducing the volume thereof. In the case of a 20 inch picture tube, the maximum thickness thereof is only 5 cm so that it can be adopted for a wall television. Also, since a high-voltage power is not required, the overall power consumption is lowered. Also, the resolution is increased owing to its 2100 horizontal lines, compared with a conventional 19 inch color picture tube having 600 lines.

23 Claims, 9 Drawing Sheets

FLAT PICTURE TUBE

This is a continuation of application Ser. No. 08/428,646 filed Apr. 25, 1995, now U.S. Pat. No. 5,804,916.

BACKGROUND OF THE INVENTION

The present invention relates to a picture tube for casting an image, and more particularly, to a flat picture tube which is plane-shaped.

Generally, a picture tube casts an image by radiating a luminescent material utilizing emitted heat electrons.

FIG. 1 is a schematic diagram of a conventional color picture tube.

As shown in FIG. 1, the conventional color picture tube is constituted by an electron gun 1, deflection yokes 3 and 4, a shadow mask 6, a fluorescent plane 5 and a high-voltage power supply 7.

The electron gun 1 having three primary color red, green and blue electron guns emits red, green and blue electron beams 8.

The deflection yokes 3 and 4 converge the red, green and blue electron beams 8 emitted from the electron gun 1 into one spot of the shadow mask 6.

The shadow mask 6 having a plurality of holes formed inside the fluorescent plane 5 makes the electron beams 8 emitted from the electron gun 1 pass through one hole to emit to the fluorescent plane 5.

The fluorescent plane 5 is radiated by the electron beams 8 passed through the shadow mask 6 such that red, green and blue luminescent materials are uniformly distributed on a curved glass plane 2.

The high-voltage power supply 7 absorbs electrons used for radiating in the fluorescent plane 5 and supplies a high-voltage power to the electron gun 1.

When the high-voltage power is supplied from the high-voltage power supply 7, the red, green and blue electron gun 1 heats an internally disposed heater (not shown) to emit heat electrons and the emitted heat electrons are controlled by a plurality of grids (not shown) to then be emitted as electron beams 8.

The red, green and blue electron beams 8 emitted from the red, green and blue electron gun 1 are converged into a hole of the shadow mask 6 by means of the deflection yokes 3 and 4 to pass therethrough.

The red, green and blue electron beams 8 passing through the hole of the shadow mask 6 impinge on the red, green and blue fluorescent material of the fluorescent plane 5 to then be radiated.

However, since the conventional color picture tube should necessarily require the electron gun 1 and deflection yokes 3 and 4, the volume thereof becomes larger. Also, since high-voltage power should be supplied for emitting electron beams 8, the electricity consumption becomes higher.

SUMMARY OF THE INVENTION

To solve the above-described problems, it is an object of the present invention to provide a flat picture tube which minimizes the volume thereof by removing an electron gun and deflection yokes and lowers an electricity consumption.

To accomplish the above object, the flat picture tube according to the present invention comprises: a glass vessel which is internally evacuated; a heater installed inside the glass vessel for emitting heat electrons; a plurality of anodes extended in one direction and disposed at a constant interval on one inner plane of the glass vessel for absorbing the heat electrons; a plurality of fluorescent units disposed on the plurality of anodes in a matrix-shape for radiating depending on heat electrons absorbed to the anodes; and a plurality of control grids extended perpendicularly to the anode extended direction and disposed in a constant interval for controlling the absorption of the heat electrons toward the anodes.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
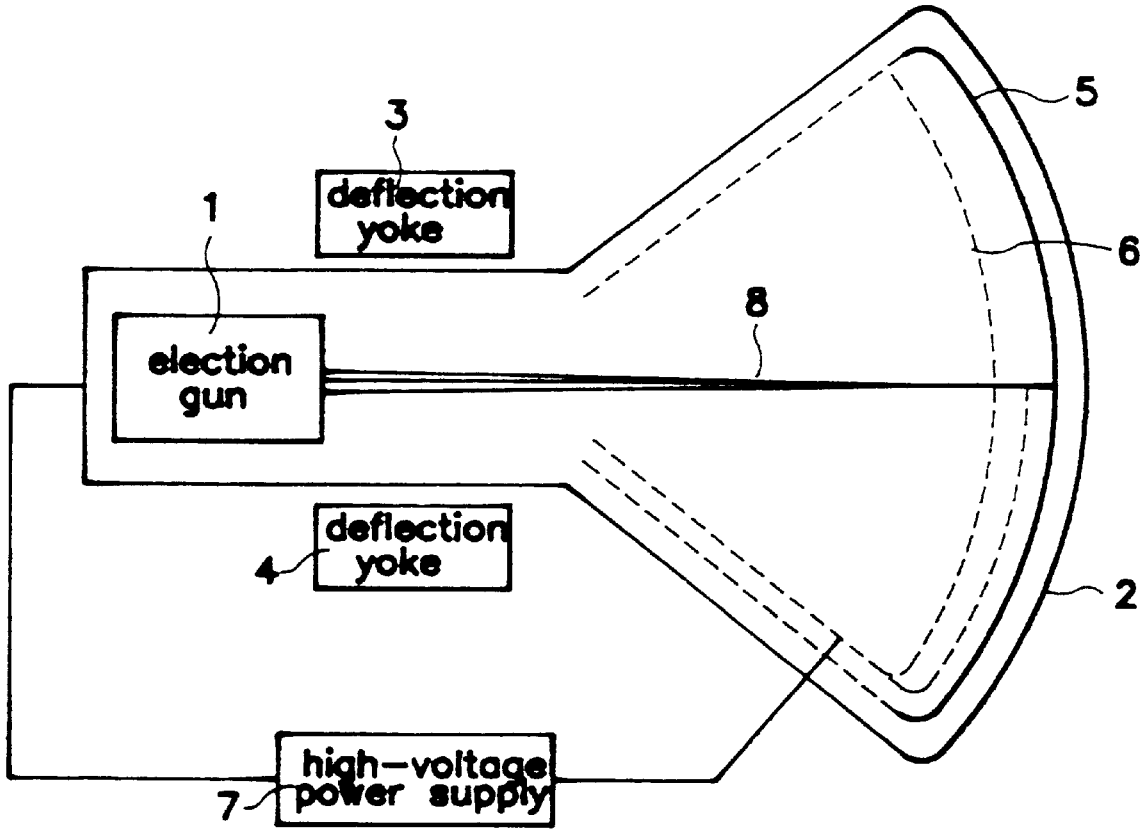
FIG. 1 PRIOR ART
FIG. 1 is a schematic diagram of a conventional color picture tube.
Figure 2:
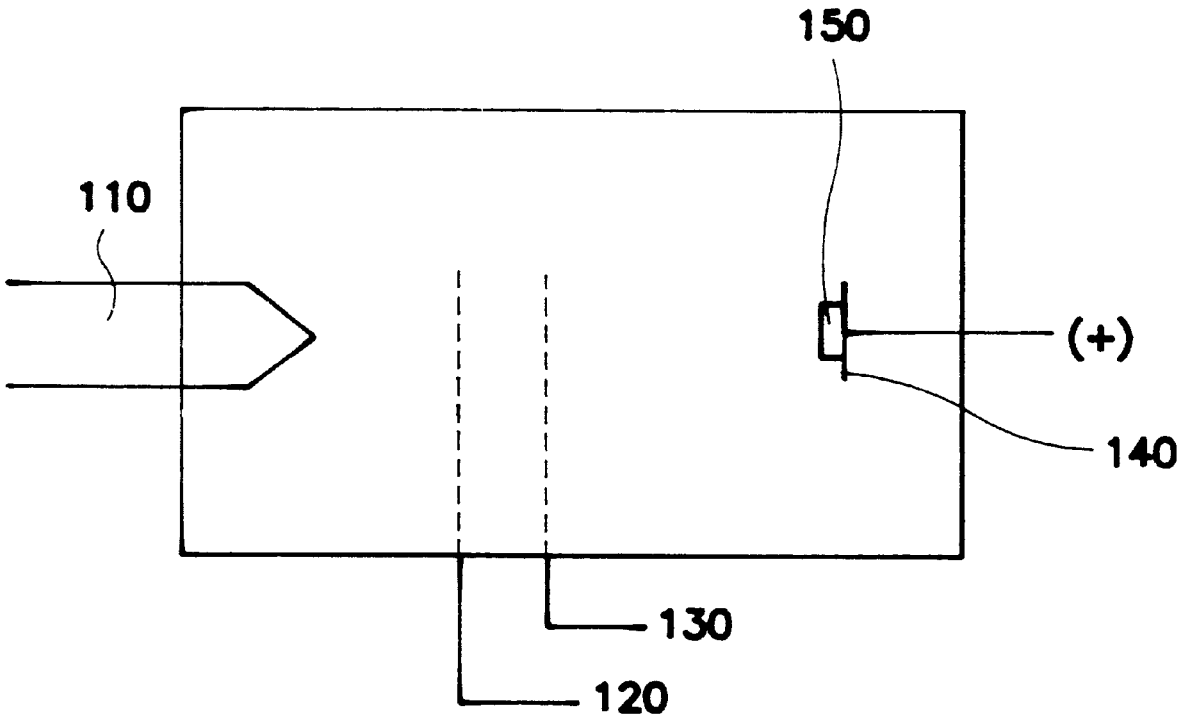
FIG. 2 is a schematic diagram of a flat picture tube according to the present invention.

As shown in FIG. 2, the flat picture tube according to the present invention includes a filament 110, a control grid 120, a screen grid 130 and an anode 140 having a fluorescent unit 150.

The filament 110 is a heater for emitting heat electrons. The control grid 120 adjusts an electric level difference and adds or subtracts the amount of the heat electrons emitted from the filament 110. The screen grid 130 receives a positive voltage close to the anode 140 and controls the electrons passed through the control grid 120 to be further accelerated. The anode 140, a positive electrode, has a fluorescent unit formed on the whole surface thereof and allows the electrons accelerated via the screen grid 130 to be absorbed and radiated.

Referring to FIG. 2, the basic operation of the flat picture tube will now be described.

When the filament 110 is heated to then emit heat electrons, the emitted heat electrons are increased or decreased depending on the electric level difference of the control grid 120 while passing through the control grid 120. That is, the electrons emitted from the filament 110 are directly drawn to, absorbed by, and transmitted through the control grid 120.

The electrons passed through the control grid 120 are accelerated in their velocity while passing through the screen grid 130 and collide with the anode 140 on which the fluorescent unit 150 is formed to then be radiated.

Here, red fluorescent unit R, green fluorescent unit G and blue fluorescent unit B are formed on the anode 140 in a matrix type and a color picture tube is completed by forming each independent electrode.

Figure 3A:
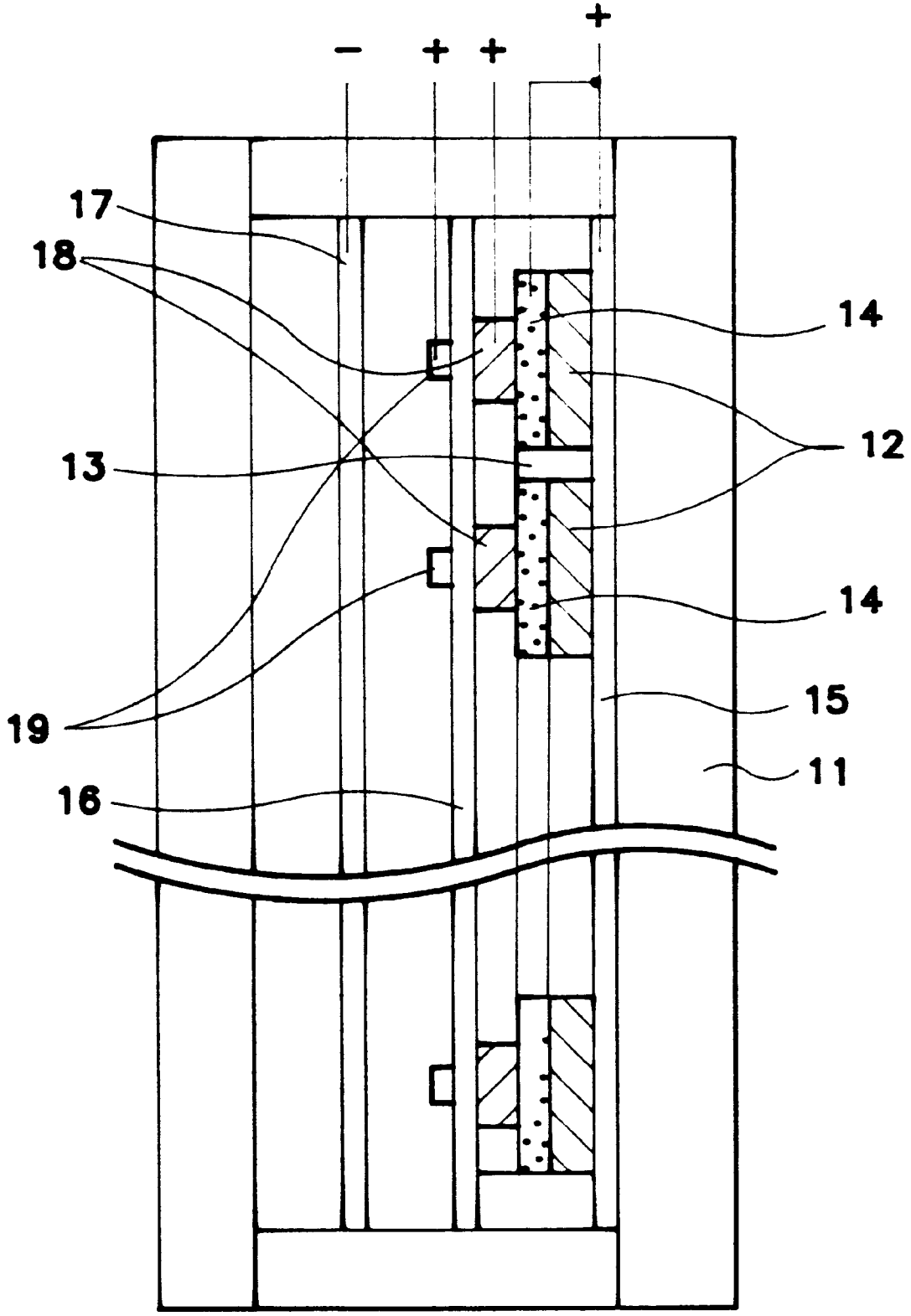
FIGS. 3A and 3B show an embodiment of the flat picture tube according to the present invention.
Figure 3B:
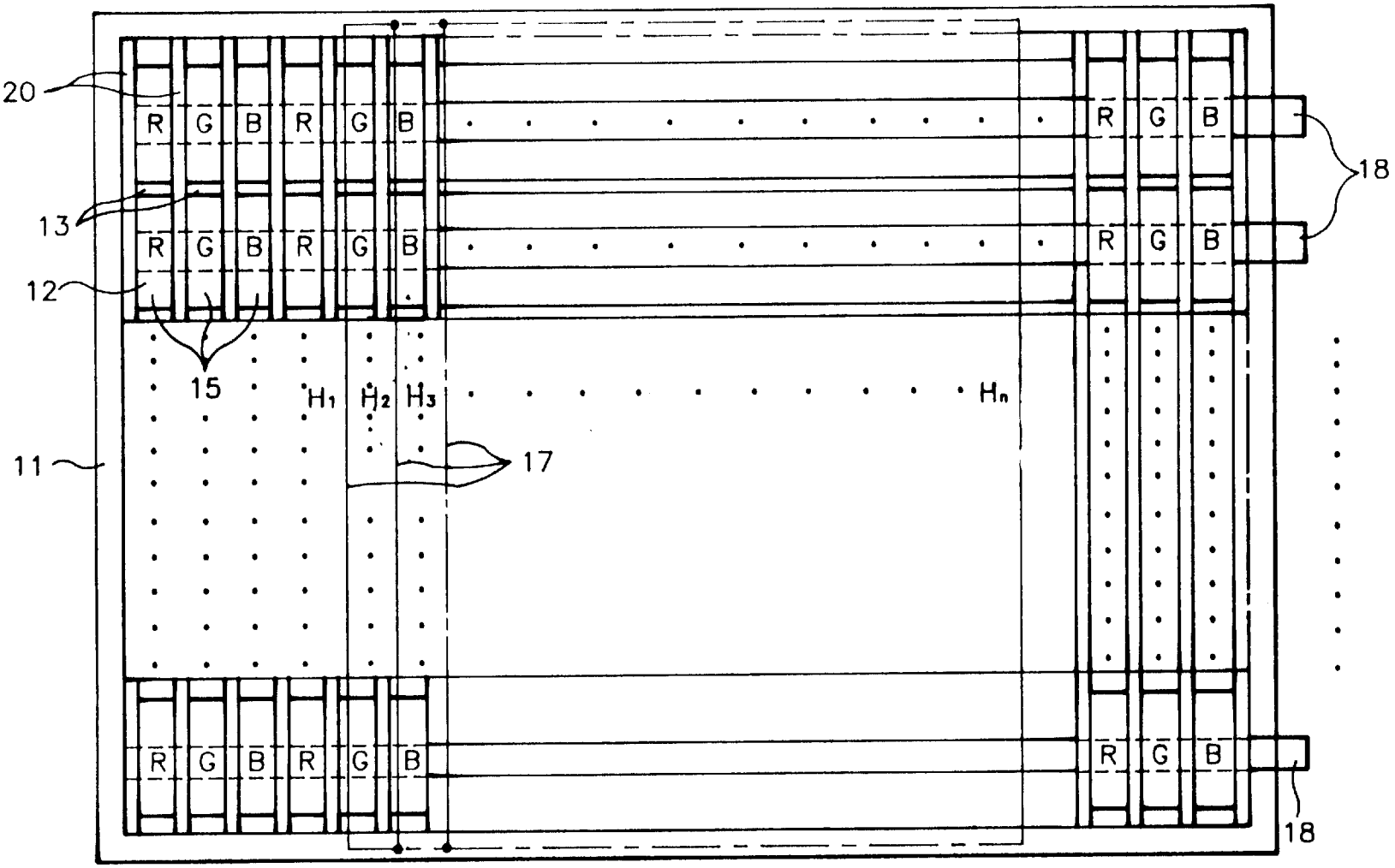

FIG. 3 is a block diagram of the flat picture tube according to an embodiment of the present invention, in which FIG. 3A is a cross-sectional view thereof and FIG. 3B is a plan view thereof.

As shown in FIGS. 3A and 3B, the flat picture tube according to an embodiment of the present invention is constituted by an anode 15, a heater 17, a screen grid 18, a control grid 19, a fluorescent unit 12 and a glass vessel 11.

The heater 17 for emitting heat electrons is constituted by 40 vertical line heaters or a plurality of filaments extending vertically for distributing the heat electrons uniformly, where the distance between lines is about 10 mm.

Also, a net heater may be adopted as the heater 17 for the purpose of distributing the heat electrons uniformly.

When vertical line heaters or filaments are used as the heater 17, the numbers thereof are determined depending on the electric specification, size of the flat picture tube or heat electron emission quantity.

Since the power supplied to the heater 17 can be devised to range from 3V to 250 for both direct and alternate currents, a high-voltage power is not required.

The anode 15 for absorbing and radiating the heat electrons emitted from the heater and receiving a positive (+) power is formed by plating vertical transparent metal lines extending vertically to a plane glass surface 2 and disposed in a constant interval.

An insulator 20 is formed between the lines of the anode 15 composed of the vertical transparent metal lines to produce an electric insulation. The width of the vertical transparent metal line, i.e., anode 15, is 0.11 mm and that of the insulator 20 being between the anode 15 is 0.08 mm.

Since the quantity of the anode 15 is determined by the number of television lines determining the horizontal resolution and a body of the red fluorescent unit R, green fluorescent unit G and blue fluorescent unit B forms a dot, the number of the anode 15 is three times the horizontal scanning lines and the electrode is protruded outwardly to apply a horizontal synchronization signal and video signal.

For example, in the case of a 19 inch picture tube, since the anode 15 is composed of 2100 vertical transparent metal lines, the resolution is greatly improved compared to that of the conventional picture tube having 600 lines.

The horizontal synchronization signal generates pulses of 'high' state corresponding to the horizontal scanning lines.

The fluorescent unit 12 is disposed on the anode 15 in a matrix shape and radiates depending on the heat electrons absorbed into the anode 15 and is formed by alternately printing the red fluorescent unit R, green fluorescent unit G and blue fluorescent unit B in turn horizontally on the anode 15 using a silk net.

At this time, in order to dispose the fluorescent unit 12 in the matrix shape, the insulator 13 is disposed in a constant interval so as to form fluorescent units 12 of the number corresponding to that of screen grids 18 vertically or control grids 19, i.e., vertical scanning lines, for arranging fluorescent units 12 in a matrix shape, the insulator 13 produces an optical insulation.

For example, in the case of a 19 inch picture tube, the fluorescent unit 12 is formed 0.46 mm vertically and the insulator 13 is formed 0.11 mm vertically. The vertical scanning lines are preset in a broadcasting station and are 525 in the case of a National Television Standard Committee (NTSC) method and 1050 in the case of a High Definition Television (HDTV) method.

Therefore, the insulator 13 is composed of 526 lines in the case of an NTSC method and 1051 in the case of a HDTV method.

The vertical synchronization signal generates pulses of 'high' state corresponding to the vertical scanning lines.

Also, an aluminum film is deposited on the red fluorescent unit R, green fluorescent unit G and blue fluorescent unit B to form a metal back 14 and an insulation net (not shown) is adhered to the metal back 14.

The screen grid 18 installed on the insulation net being on the metal back 14 for controlling the heat electrons emitted from the heater 17 and being between the heater 17 and anode 15 so as not to be absorbed into the anode 15, regulates the absorption velocity, each extends horizontally and is disposed in a constant interval. The electrode is protruded outwardly to supply a vertical synchronization signal and a video signal may be input thereto.

That is to say, the screen grid 18 is formed such that the vertical scanning lines of a predetermined number, e.g., 525, are disposed vertically in a constant interval.

The screen grid 18 and control grid 19 are isolated by installing on the screen grid 18 a shallow electric insulator 16 through which heat electrons can pass.

The control grid 19 installed on the insulator 16 for controlling the heat electrons emitted from the heater 17 and being between the heater 17 and anode 15 so as not to be absorbed into the anode 15, each extends horizontally and is disposed in a constant interval. The electrode is protruded outwardly to supply a vertical synchronization signal and a video signal may be input thereto.

That is to say, the control grid 19 is formed such that the vertical scanning lines of a predetermined number, e.g., 525, are disposed horizontally and in a constant interval to then be adhered to the insulator 16.

The horizontal synchronization signal corresponding to a horizontal synchronization signal for a television generates pulses of 'high' state of the same number as that of the horizontal scanning lines and is applied to the anode 15 corresponding to the red fluorescent unit R, green fluorescent unit G and blue fluorescent unit B coupled in a body.

Also, the vertical synchronization signal corresponds to a vertical synchronization signal for a television and generates 'high' state pulses of the same number as that of the vertical scanning lines. Only a pulse maintaining a 'high' state is generated until the pulses of a horizontal synchronization signal are all applied horizontally to the anode 15 of one line, that is, until the pulses of a synchronization signal corresponding to the number of the red fluorescent unit R, green fluorescent unit G and blue fluorescent unit B coupled in a body are applied thereto.

The glass vessel 11 forming external appearance with a plane glass, includes an anode 15, heater 17, control grid 19 and screen grid 18 inside thereof and evacuates or radiates by injecting gas.

Figure 4A:
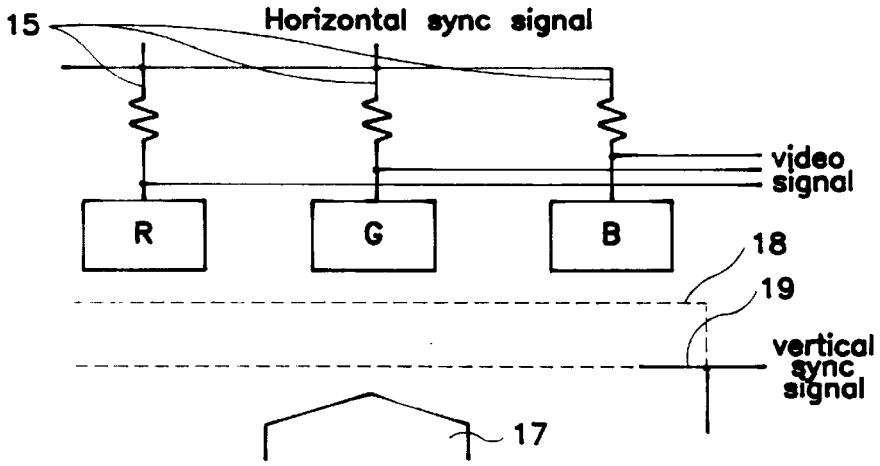
FIGS. 4A, 4B and 4C shows the operational state of FIGS. 3A and 3B.
Figure 4B:
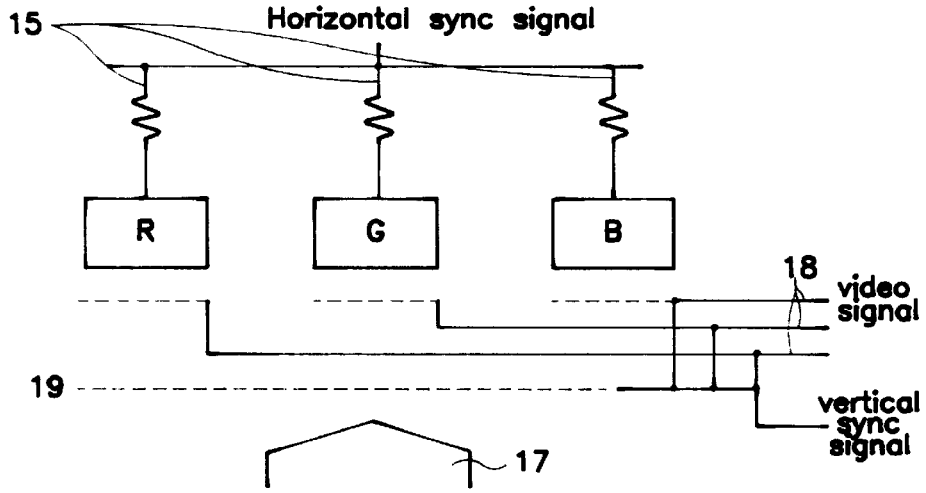
Figure 4C:
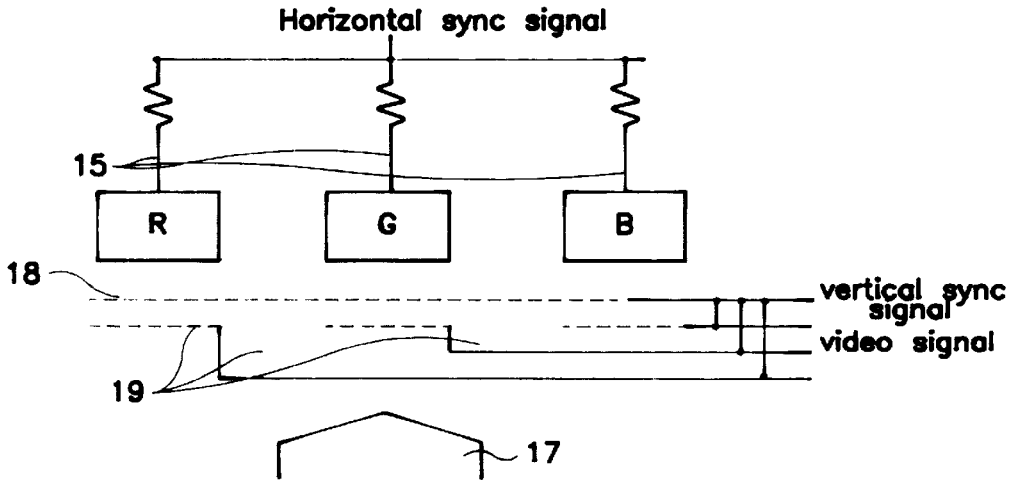

FIGS. 4A, 4B and 4C are diagrams for showing the operational state of FIG. 3.

The operation of the flat picture tube according to an embodiment of the present invention with reference to FIGS. 4A, 4B and 4C.

The red fluorescent unit R, green fluorescent unit G and blue fluorescent unit B of the anode 15 are coupled in a body and operate according to the anode 15, screen grid 18 and control grid 19, which are synchronized according to a horizontal synchronization signal and vertical synchronization signal.

That is to say, if the horizontal synchronization signal input to the anode 15 and the vertical synchronization signal input to the screen grid 18 and control grid 19 become a positive (+) electrode to then be synchronized, the red fluorescent unit R, green fluorescent unit G and blue fluorescent unit B corresponding to the synchronized dots radiate and their luminance is adjusted.

In other words, the red fluorescent unit R, green fluorescent unit G and blue fluorescent unit B of which both vertical synchronization signal and horizontal synchronization signal are 'high' states radiate. At this time, the red fluorescent unit R, green fluorescent unit G and blue fluorescent unit B radiate in turn horizontally depending on the periods of the horizontal synchronization signal and vertical synchronization signal. Then, the red fluorescent unit R, green fluorescent unit G and blue fluorescent unit B of the next line radiate in turn. Thus, for a period of the vertical synchronization signal, every fluorescent unit of the flat picture tube radiates once.

At this time, the horizontal synchronization signal and vertical synchronization signal not to be radiated become a 'low' state and exist in a wait state.

Also, the luminance of the radiated red fluorescent unit R, green fluorescent unit G and blue fluorescent unit B is determined by the input video signal.

The input state of the video signal, vertical synchronization and horizontal synchronization signal will be described in detail.

First, as shown in FIG. 4A, in the case of applying the video signal to the anode 15, if a horizontal synchronization signal is applied to the anode 15 in which the red fluorescent unit R, green fluorescent unit G and blue fluorescent unit B are coupled through a load resistance and a vertical synchronization signal is applied to the control grid 19, the fluorescent unit of the corresponding dots is synchronized.

At this time, if the video signal is input to the anode 15 of the red fluorescent unit R, green fluorescent unit G and blue fluorescent unit B, the luminance of the red fluorescent unit R, green fluorescent unit G and blue fluorescent unit B varies accordingly to then produce various colors.

Also, as shown in FIG. 4B, in the case of applying the video signal to the screen grid 18, if a horizontal synchronization signal is applied to the anode 15 in which the red fluorescent unit R, green fluorescent unit G and blue fluorescent unit B are coupled through a load resistance and a vertical synchronization signal is applied to the screen grid 18 and control grid 19, the fluorescent unit of the corresponding dots is synchronized.

At this time, if the video signal is input to each screen grid 18 corresponding to the red fluorescent unit R, green fluorescent unit G and blue fluorescent unit B, the luminance of the red fluorescent unit R, green fluorescent unit G and blue fluorescent unit B varies accordingly to then produce various colors.

Also, as shown in FIG. 4C, in the case of applying the video signal to the control grid 19, if a horizontal synchronization signal is applied to the anode 15 in which the red fluorescent unit R, green fluorescent unit G and blue fluorescent unit B are coupled through a load resistance and a vertical synchronization signal is applied to the screen grid 18 and control grid 19, the fluorescent unit of the corresponding dots is synchronized.

At this time, if the video signal is input to each control grid 19 corresponding to the red fluorescent unit R, green fluorescent unit G and blue fluorescent unit B, the luminance of the red fluorescent unit R, green fluorescent unit G and blue fluorescent unit B varies accordingly to then produce various colors.

Here, the vertical synchronization signal is input to the screen grid 18 through a resistance. The input vertical synchronization signal has a voltage set to be slightly lower than that applied to the control grid 19.

Figure 5A:
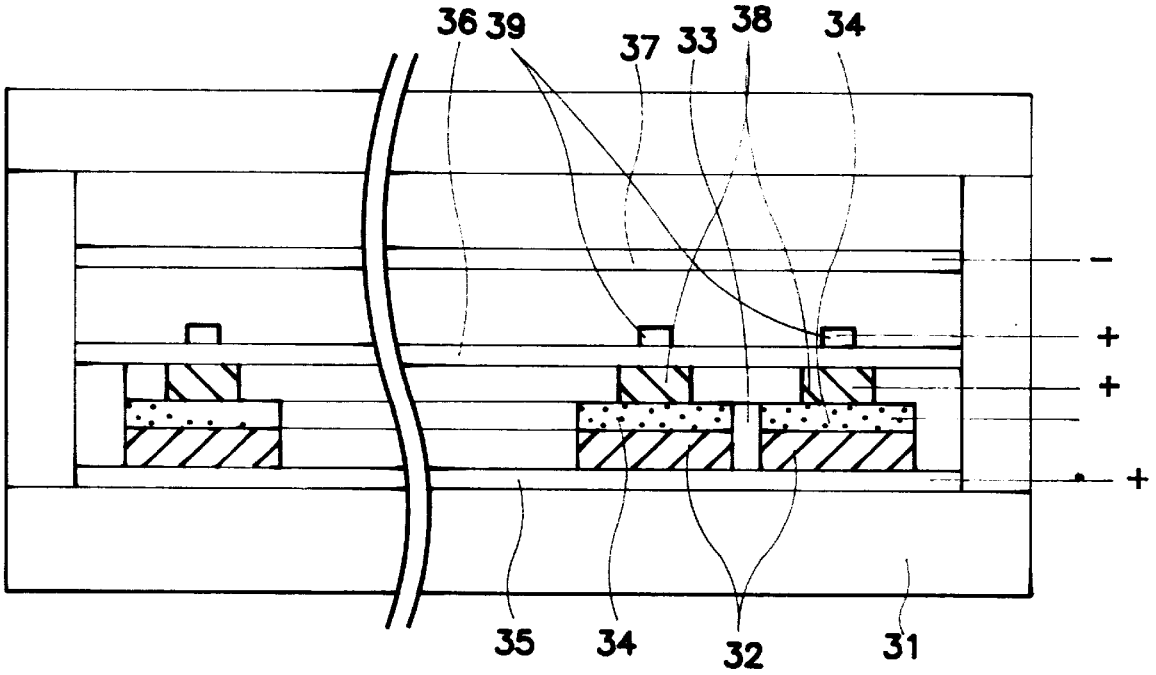
FIGS. 5A and 5B show another embodiment of the flat picture tube according to the present invention.
Figure 5B:
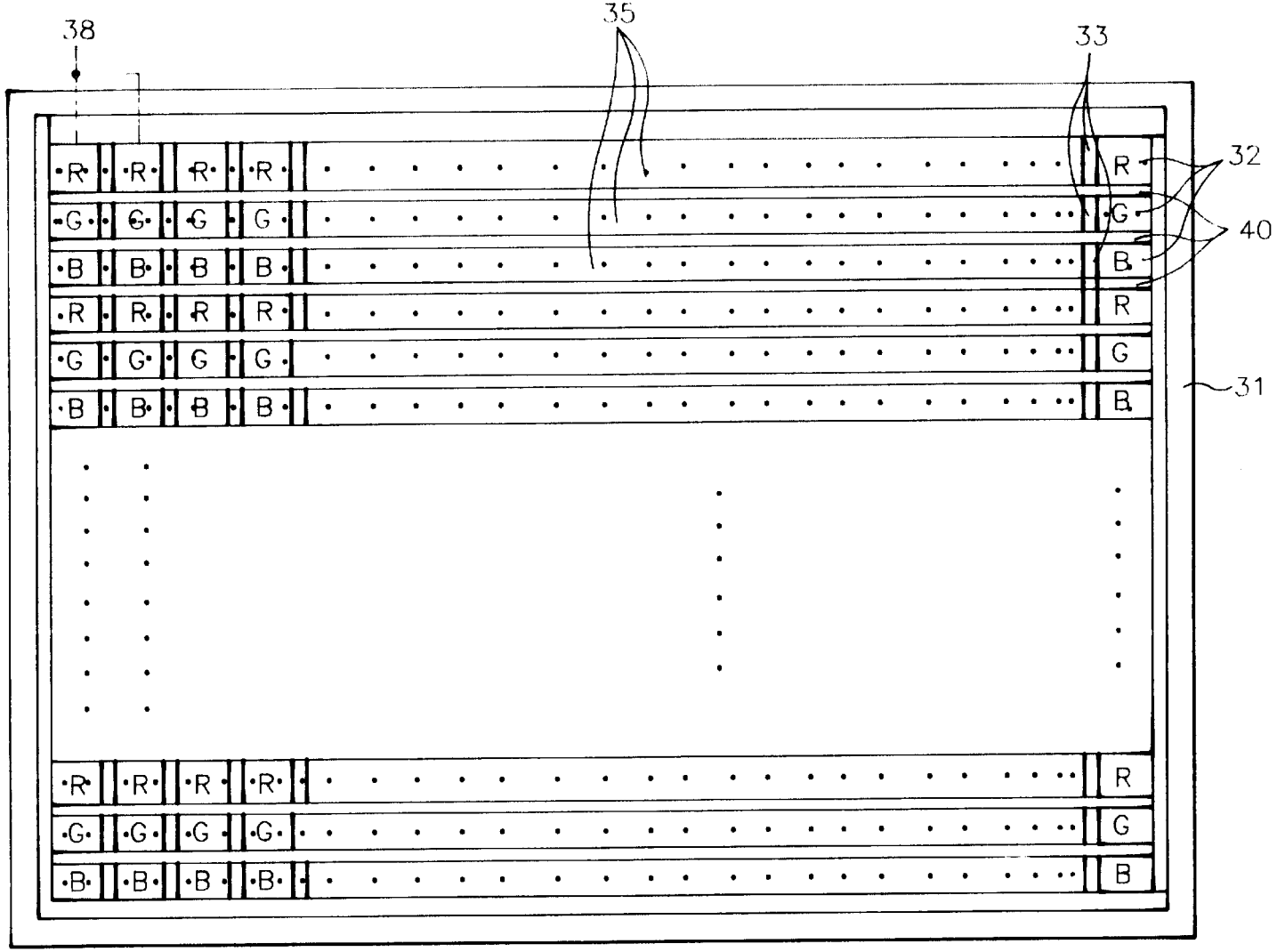

FIGS. 5A and 5B are diagrams of the flat picture tube according to another embodiment of the present invention, in which FIG. 5A is a cross-sectional view thereof and FIG. 5B is a plan view thereof.

As shown in FIGS. 5A and 5B, the flat picture tube according to another embodiment of the present invention is constituted by an anode 35, a heater 37, a screen grid 38, a control grid 39, a fluorescent unit 32 and a glass vessel 31.

The heater 37 has the same structure and function as those shown in FIG. 3.

The anode 35 for absorbing and radiating the heat electrons emitted from the heater and receiving a positive (+) power is formed by plating vertical transparent metal lines extending horizontally to a plane glass surface 2 and disposed in a constant interval.

An insulator 40 is formed between the lines of the anode 35 composed of the vertical transparent metal lines to produce an electric insulation. The quantity of the anodes 35 depends on the number of vertical scanning lines of a television. Since a dot is formed by the red fluorescent unit R, green fluorescent unit G and blue fluorescent unit B which are coupled in a body, the number of the anodes 35 corresponds to three times the number of vertical scanning lines.

Vertical scanning lines are 525 in the case of an NTSC method and 1050 in the case of a HDTV method. Therefore, the anodes 35 numbers 525×3 or 1050×3. In the anodes 35, since the electrode is protruded to apply a vertical synchronization signal or a video signal is applied thereto.

The fluorescent unit 32 disposed on the anode 35 in a matrix shape for emitting light depending on the heat electrons absorbed into the anode 35 is formed by alternately silk-net printing the red fluorescent unit R, green fluorescent unit G and blue fluorescent unit B on the anode 35 vertically in turn.

At this time, in order to dispose the fluorescent unit 32 in the matrix shape, the insulator 33 is disposed in a constant interval so as to form fluorescent units 32 of the number corresponding to that of screen grids 38 or control grids 39 horizontally, i.e., vertical scanning lines, for arranging fluorescent units 32 in a matrix shape, the insulator 33 produces an optical insulation.

Also, an aluminum film is deposited on the red fluorescent unit R, green fluorescent unit G and blue fluorescent unit B to form a metal back 34 and an insulation net (not shown) is adhered to the metal back 34.

The screen grid 38 installed on the insulation net being on the metal back 34 for controlling the heat electrons emitted from the heater 37 and being between the heater 37 and anode 35 so as not to be absorbed into the anode 35, regulates the absorption velocity, each extends vertically and is disposed in a constant interval. The electrode is protruded outwardly to supply a horizontal synchronization signal.

That is to say, the screen grid 38 is formed such that the horizontal scanning lines of a predetermined number, e.g., 700 in the case of a 19 inch picture tube, are disposed horizontally in a constant interval to then be adhered to the metal back 34.

Also, in the case of a 19 inch picture tube, since the horizontal scanning lines are 700, the resolution thereof is greatly increased compared with that of the conventional picture tube having 600 lines.

The screen grid 38 and control grid 39 are isolated by installing on the screen grid 38 a shallow electric insulator 36 through which heat electrons can pass.

The control grid 39 installed on the insulator 36 for controlling the heat electrons emitted from the heater 37 and being between the heater 37 and anode 35 so as not to be absorbed into the anode 35, each extends vertically and is disposed in a constant interval. The electrode is protruded outwardly to supply a horizontal synchronization signal and a video signal may be input thereto.

That is to say, the control grid 39 is formed such that the horizontal scanning lines of a predetermined number, e.g., 700, are disposed vertically in a constant interval to then be adhered to the insulator 36.

The horizontal synchronization signal corresponding to a horizontal synchronization signal for a television generates pulses of 'high' state of the same number as that of the horizontal scanning lines and is applied to the screen grid 38 and control grid 39

Also, the vertical synchronization signal corresponding to a vertical synchronization signal for a television generates pulses of a 'high' state corresponding to the same number of that of vertical scanning lines. Also, only a pulse maintaining a 'high' state is generated until the pulses of the horizontal synchronization signal are all applied horizontally to the screen grid 38 and control grid 39 of one line.

Also, the vertical synchronization signal is applied to three anodes 35 with the red fluorescent unit R, green fluorescent unit G and blue fluorescent unit B coupled in a body.

The glass vessel 31 forming external appearance with a plane glass, includes an anode 35, heater 37, control grid 39 and screen grid 38 inside thereof and evacuates or radiates by injecting gas.

Figure 6A:
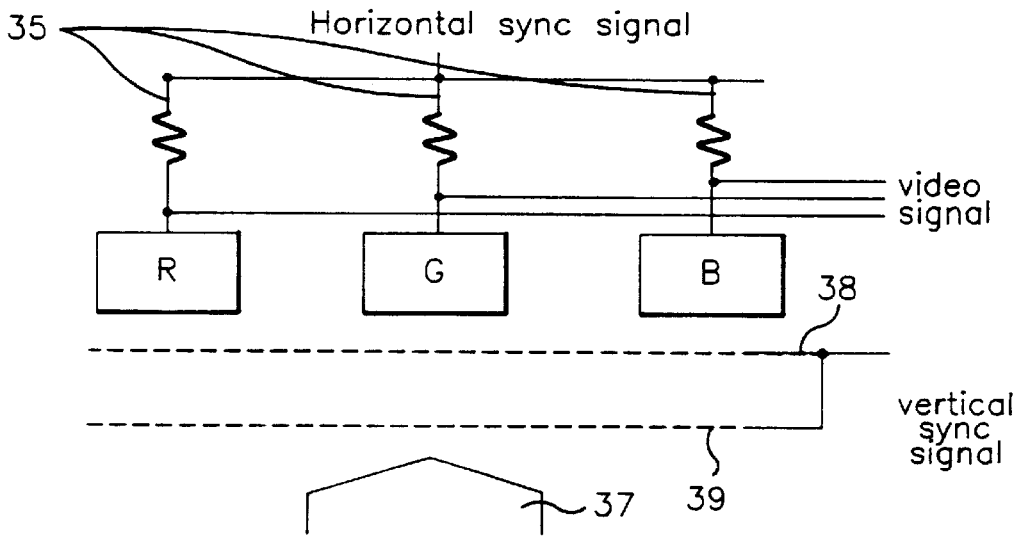
FIGS. 6A and 6B show the operational state of FIGS. 5A and 5B.
Figure 6B:
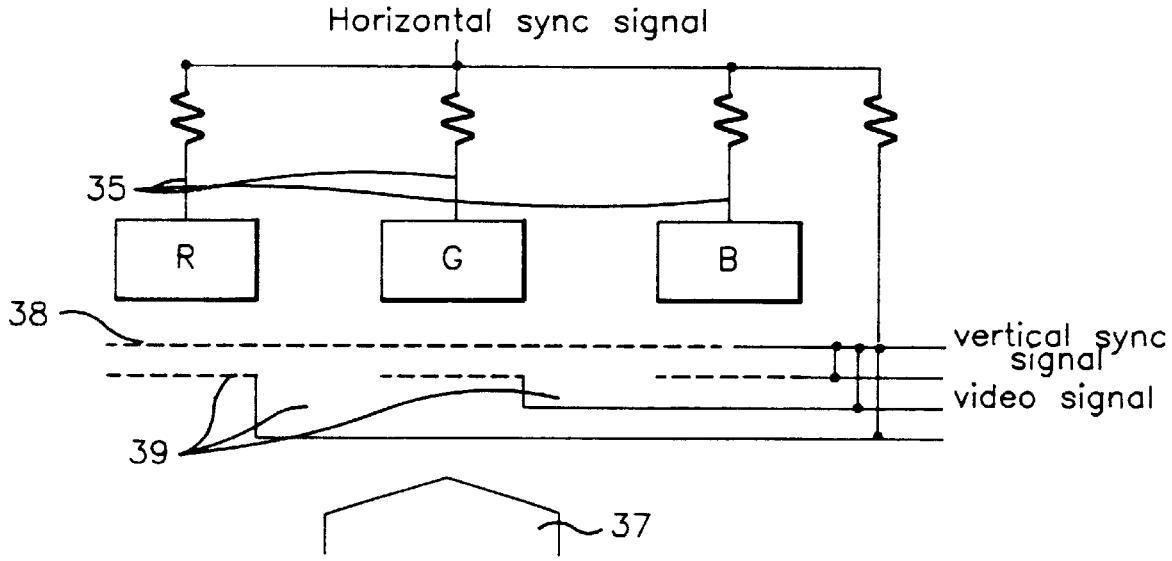

FIGS. 6A and 6B are diagrams for showing the operational state of FIG. 5.

The operation of the flat picture tube according to another embodiment of the present invention with reference to FIGS. 6A and 6B.

The red fluorescent unit R, green fluorescent unit G and blue fluorescent unit B of the anode 35 are coupled in a body and operate according to the anode 35, screen grid 38 and control grid 39, which are synchronized according to a horizontal synchronization signal and vertical synchronization signal.

That is to say, if the vertical synchronization signal input to the anode 35 and the horizontal synchronization signal input to the screen grid 38 and control grid 39 become a positive (+) electrode to then be synchronized, the red fluorescent unit R, green fluorescent unit G and blue fluorescent unit B corresponding to the synchronized dots radiate and their luminance is adjusted.

In other words, the red fluorescent unit R, green fluorescent unit G and blue fluorescent unit B of which both vertical synchronization signal and horizontal synchronization signal are 'high' states radiate. At this time, the red fluorescent unit R, green fluorescent unit G and blue fluorescent unit B radiate in turn horizontally depending on the periods of the vertical synchronization signal and vertical synchronization signal. Then, the red fluorescent unit R, green fluorescent unit G and blue fluorescent unit B of the next line radiate in turn. Thus, for a period of the vertical synchronization signal, every fluorescent unit of the flat picture tube radiates once.

At this time, the horizontal synchronization signal and vertical synchronization signal not to be radiated become a 'low' state and exist in a wait state.

Also, the luminance of the radiated red fluorescent unit R, green fluorescent unit G and blue fluorescent unit B is determined by the input video signal.

The input state of the video signal, vertical synchronization and horizontal synchronization signal will be described in detail.

First, as shown in FIG. 6A, in the case of applying the video signal to the anode 35, if a vertical synchronization signal is applied to the anode 35 in which the red fluorescent unit R, green fluorescent unit G and blue fluorescent unit B are coupled through a load resistance and a horizontal synchronization signal is applied to the control grid 39, the fluorescent unit of the corresponding dots is synchronized.

At this time, if the video signal is input to the anode 35 of the red fluorescent unit R, green fluorescent unit G and blue fluorescent unit B, the luminance of the red fluorescent unit R, green fluorescent unit G and blue fluorescent unit B varies accordingly to then produce various colors.

Also, as shown in FIG. 6B, in the case of applying the video signal to the control grid 39, if a horizontal synchronization signal is applied to the anode 35 in which the red fluorescent unit R, green fluorescent unit G and blue fluorescent unit B are coupled through a load resistance and a vertical synchronization signal is applied to the screen grid 38 and control grid 39, the fluorescent unit of the corresponding dots is synchronized.

At this time, if the video signal is input to each control grid 39 corresponding to the red fluorescent unit R, green fluorescent unit G and blue fluorescent unit B, the luminance of the red fluorescent unit R, green fluorescent unit G and blue fluorescent unit B varies accordingly to then produce various colors.

Here, a horizontal synchronization signal is applied to the screen grid 38 through a resistance. The input vertical synchronization signal applied to the screen grid 38 has a voltage set to be slightly lower than that applied to the control grid 39.

Figure 7:
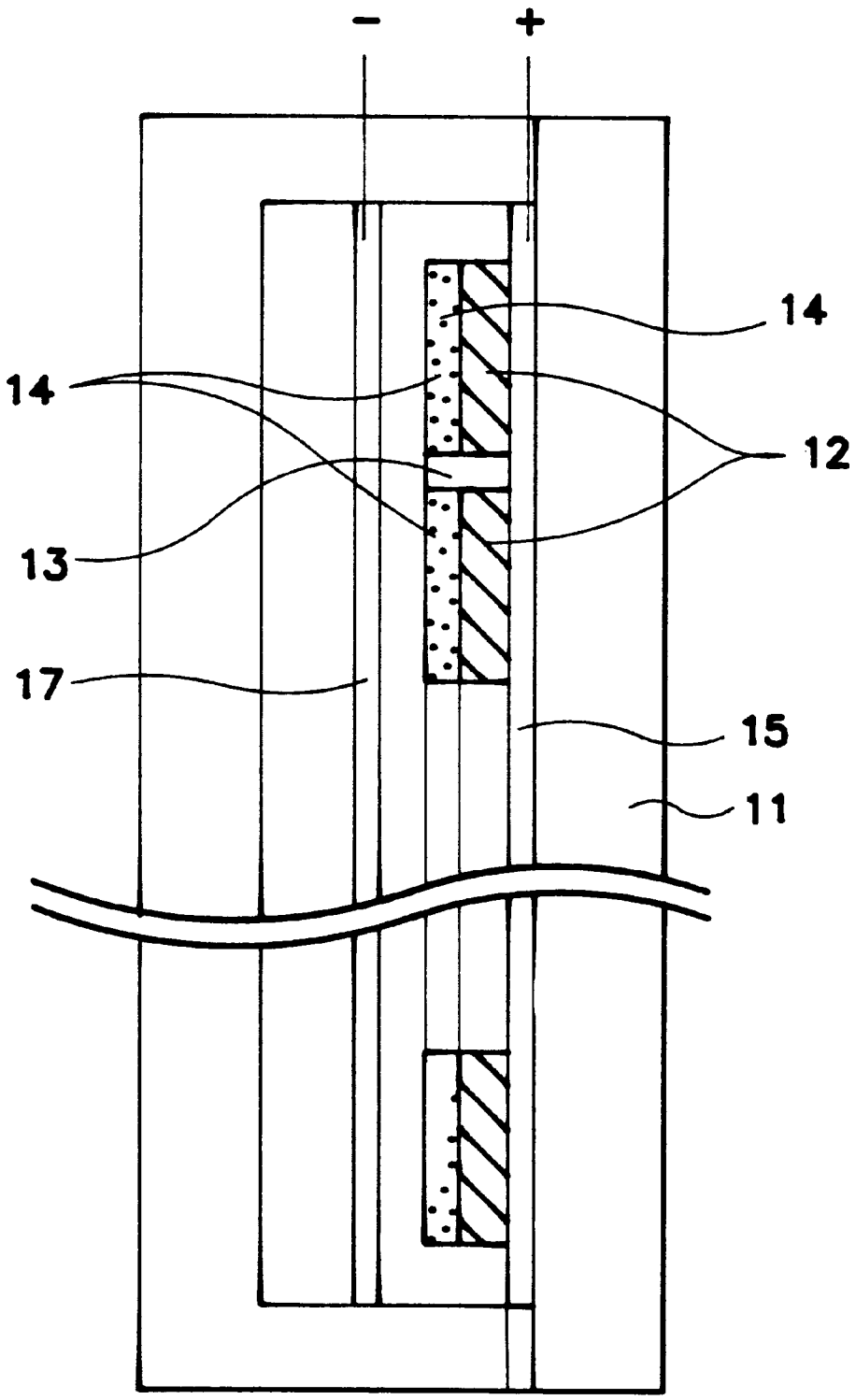
FIG. 7 shows still another embodiment of the flat picture tube according to the present invention.

FIG. 7 is a cross-sectional view of the flat picture tube according to another embodiment of the present invention.

As shown in FIG. 7, the flat picture tube according to another embodiment of the present invention is integrally formed with a screen grid 18 by connecting electrodes with a metal back 14. That is to say, without a separate grid, the metal back 14 deposited on a fluorescent unit 12 is used as a grid.

In other words, by connecting the electrodes with the metal back 14, the heat electrons emitted from a heater 17 is controlled so as not to be absorbed into the fluorescent unit 12 of an anode 15.

Therefore, since the flat picture tube according the present invention is constituted in a matrix digital method to be operated, an electron gun and deflection yokes are not necessary, which results in reduced volume. In the case of a 20 inch picture tube, since the maximum thickness thereof is 5 cm, the picture tube can be adopted for a wall television. Also, since a high-voltage power is not required, the overall electricity consumption is lowered. Further, compared with a conventional 19 inch color picture tube having 600 horizontal lines, since the flat picture tube according to the present invention has 2100 horizontal lines, the resolution thereof becomes considerably increased.

What is claimed is:

1. A flat picture tube, comprising:

a glass vessel;

a heater installed inside said glass vessel for emitting heat electrons;

a plurality of fluorescent units arranged in a fluorescent unit matrix having rows and columns;

a plurality of anode elements extending in a first direction, each of said anode elements being individually actuable and corresponding to a single row of said fluorescent unit matrix; and a plurality of control elements extending in a second direction non-parallel to said first direction, each of said control elements being separately actuable and corresponding to a single column of said fluorescent unit matrix such that each control element overlaps each anode element at a position of a fluorescent unit, wherein a selected fluorescent unit is individually energized by actuating the anode element corresponding to the row of said selected fluorescent unit and by actuating the control element corresponding to the column of said selected fluorescent unit, and electrons emitted from said heater are directly drawn to, absorbed by, and transmitted through the actuated control element, and absorbed by the activated anode element to energize said selected fluorescent unit.

2. The flat picture tube as claimed in claim 1, further comprising a plurality of screen elements extending in said second direction, each of said screen elements overlapping one of said plurality of control elements, said screen elements controlling a rate of said heat electrons absorbed into said activated anode element.

3. The flat picture tube as claimed in claim 2, wherein a metal back is formed between said screen elements and said fluorescent units.

4. The flat picture tube as claimed in claim 3, wherein an insulation net is adhered between said screen elements and said metal back.

5. The flat picture tube as claimed in claim 3, wherein said metal back is formed by depositing an aluminum film.

6. The flat picture tube as claimed in claim 1, wherein said heater is a vertical line heater.

7. The flat picture tube as claimed in claim 1, wherein said heater is a net heater.

8. The flat picture tube as claimed in claim 1, wherein each of said anode elements are formed from a transparent metal element.

9. The flat picture tube as claimed in claim 1, wherein an amount of said fluorescent units on each of said anode elements equals an amount of control elements.

10. The flat picture tube as claimed in claim 1, wherein said fluorescent units are formed such that a red fluorescent unit R, green fluorescent unit G and blue fluorescent unit B are alternatively disposed along each of said rows or each of said columns of said fluorescent unit matrix.

11. The flat picture tube as claimed in claim 1, wherein said anode elements receive a vertical synchronization signal.

12. The flat picture tube as claimed in claim 1, wherein said anode elements receive a horizontal synchronization signal.

13. The flat picture tube as claimed in claim 1, wherein said control elements of the same number as that of vertical scanning lines receive a vertical synchronization signal.

14. The flat picture tube as claimed in claim 1, wherein said control elements of the same number as that of horizontal scanning lines receive a horizontal synchronization signal.

15. The flat picture tube as claimed in claim 2, wherein said screen elements of the same number as that of vertical scanning lines receive a vertical synchronization signal.

16. The flat picture tube as claimed in claim 2, wherein said screen elements of the same number as that of horizontal scanning lines receive a horizontal synchronization signal.

17. The flat picture tube as claimed in claim 11, wherein the radiated colors are adjusted by applying a video signal to said anode elements.

18. The flat picture tube as claimed in claim 15, wherein the radiated colors are adjusted by applying a video signal to said screen elements.

19. The flat picture tube as claimed in claim 13, wherein the radiated colors are adjusted by applying a video signal to said control elements.

20. The flat picture tube as claimed in claim 12, wherein the radiated colors are adjusted by applying a video signal to said anode elements.

21. The flat picture tube as claimed in claim 15, wherein the radiated colors are adjusted by applying a video signal to said control elements.

22. The flat picture tube as claimed in claim 1, wherein said first direction is a horizontal direction.

23. The flat picture tube as claimed in claim 1, wherein said first direction is a vertical direction.

* * * * *